US007866649B2

(12) United States Patent
Saito et al.

(10) Patent No.: US 7,866,649 B2
(45) Date of Patent: Jan. 11, 2011

(54) SHEET ALIGNING APPARATUS, POST PROCESSING APPARATUS AND IMAGE FORMING APPARATUS HAVING THE SAME

(75) Inventors: Takashi Saito, Fuefuki (JP); Makoto Shimura, Nirasaki (JP)

(73) Assignee: Nisca Corporation, Minamikoma-Gun, Yamanashi (JP)

( * ) Notice: Subject to any disclaimer, the term of this patent is extended or adjusted under 35 U.S.C. 154(b) by 640 days.

(21) Appl. No.: 11/896,376

(22) Filed: Aug. 31, 2007

(65) Prior Publication Data

US 2008/0054552 A1 Mar. 6, 2008

(30) Foreign Application Priority Data

Sep. 4, 2006 (JP) ..... 2006-239580

(51) Int. Cl.
*B65H 37/04* (2006.01)

(52) U.S. Cl. ..... 270/58.12; 270/58.08; 270/58.11; 270/58.17; 270/58.27

(58) Field of Classification Search ..... 270/58.08, 270/58.09, 58.11, 58.12, 58.17, 58.27
See application file for complete search history.

(56) References Cited

U.S. PATENT DOCUMENTS

| | | | | |
|---|---|---|---|---|
| 6,264,194 | B1 * | 7/2001 | Hayashi et al. | 271/220 |
| 6,427,997 | B1 * | 8/2002 | Hirota et al. | 270/58.12 |
| 6,994,339 | B2 * | 2/2006 | Kato et al. | 270/58.12 |
| 7,185,883 | B2 * | 3/2007 | Kato et al. | 270/58.11 |
| 7,255,340 | B2 * | 8/2007 | Anezaki et al. | 271/176 |
| 7,461,837 | B2 * | 12/2008 | Saito et al. | 270/58.07 |
| 2006/0208411 | A1 * | 9/2006 | Saito et al. | 270/58.07 |

FOREIGN PATENT DOCUMENTS

| | | |
|---|---|---|
| JP | 2003-128332 | 5/2003 |

* cited by examiner

*Primary Examiner*—Leslie A Nicholson, III
(74) *Attorney, Agent, or Firm*—Manabu Kanesaka

(57) ABSTRACT

A sheet aligning apparatus includes a tray device for piling and storing sheets from a sheet outlet, a sheet discharging and delivering device arranged above the tray device, and a shift device for moving the sheet discharging and delivering device between an operating position of pressing the uppermost sheet with predetermined pressing force and a non-operating position of lightening or releasing pressing force. The apparatus also includes a regulating stopper member for colliding the sheets sent by the sheet discharging and delivering device at the sheet front or back ends for regulating sheet position, an aligning device for regulating the sheets on the tray in a direction crossing the sheet discharging direction, and a control device for controlling the sheet discharging and delivering device, the shift device and the aligning device.

5 Claims, 11 Drawing Sheets

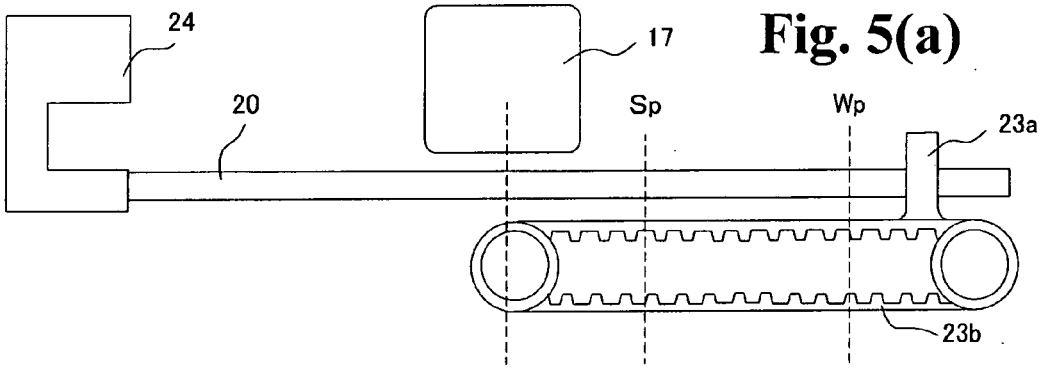
Fig. 5(a)
Fig. 5(b)
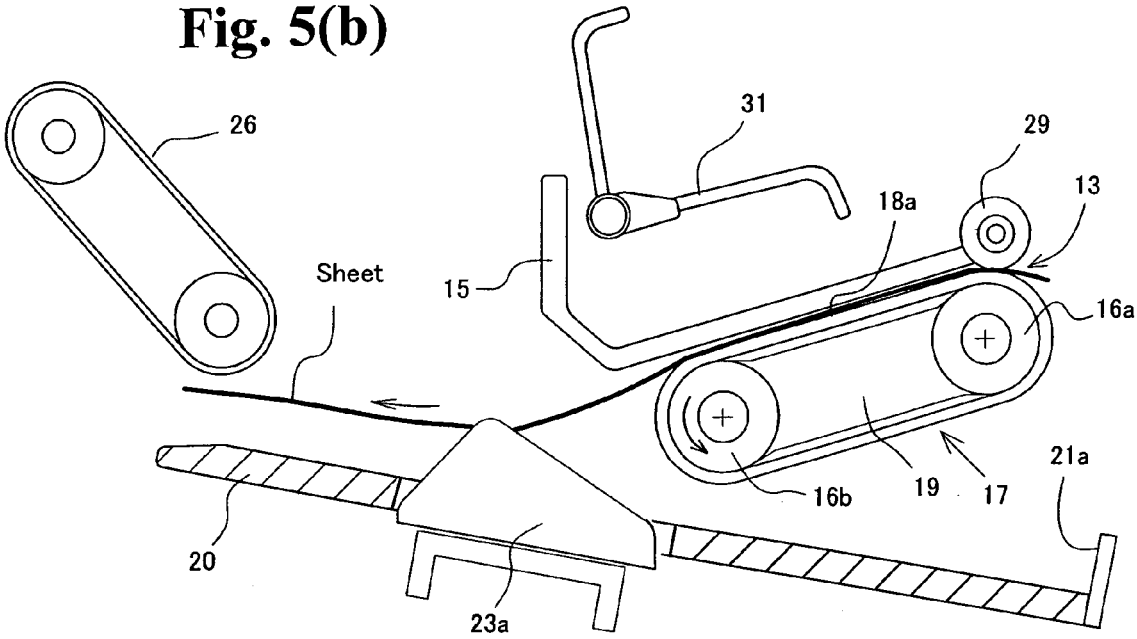
Fig. 5(c)
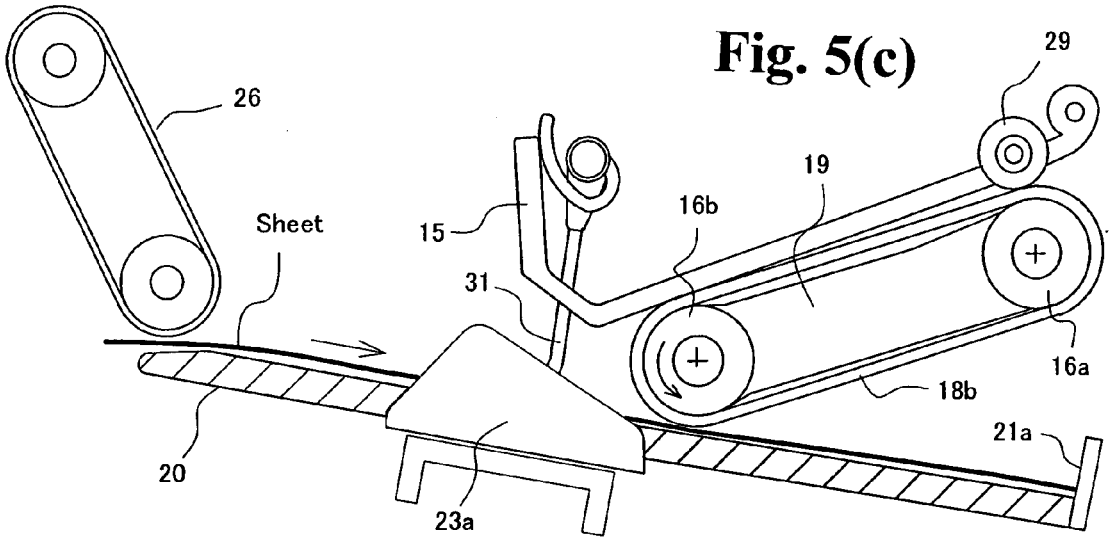

Belt retreating

Belt pressing
(Operation position)

Engagement by belt own-weight

SHEET ALIGNING APPARATUS, POST PROCESSING APPARATUS AND IMAGE FORMING APPARATUS HAVING THE SAME

BACKGROUND OF THE INVENTION AND RELATED ART STATEMENT

This invention relates to a post processing apparatus which receives sheets having images formed by an image forming apparatus such as printers, copy machines or copiers and carries out post processing like stapling, punching or stamping on the sheets, and relates to a sheet aligning apparatus which positions the sheets on the post processing apparatus at a predetermined position.

In general, this kind of sheet aligning apparatus has been broadly known as an apparatus, which sets sheets having images formed by the image forming apparatus at a predetermined position on a tray, performs on the stack of the sheets post processing such as stapling, stamping, punching or others, and stores them to a storing stacker in a downstream side. Accordingly, the process tray necessitates a sheet aligning mechanism for performing regular alignments on a stage of carrying out the post-processing to the sheets.

This kind of sheet aligning apparatus has conventionally been disclosed in, for example, Japanese Patent Application Publication No. 2003-128332. This publication document prepares set-copies by piling the sheets delivered out of the image forming apparatus on the process tray from a sheet outlet. The stack of each set is stitched by a staple device disposed at the process tray, and the stitched sheet stack is delivered to a storing tray arranged at the downstream of the process tray.

Therefore, the process tray is equipped with reciprocally delivering rollers, conveys the sheets from the sheet outlet to the downstream side along the process tray, reversely rotates the delivering rollers after the sheets have been guided at their backward ends on the process tray, and switches back the sheets thereon.

The process tray is furnished with a restraining stopper for pushing the sheets at their back ends thereto in order to regulate to position the sheets. Although not illustrating in the Patent Publication Document, the process tray is provided with a sheet width regulating plate for positioning the sheets at their one-sides to a standard position.

With this structure, the sheets from the sheet outlet are piled on the process tray to carry out the set-copies justification, and at the same time, the sheets are aligned at the predetermined position.

When piling to align the sheets on the process tray as mentioned above, there have conventionally been arranged with conveyor means for moving the sheets in a conveying direction and aligning means for moving the sheets in a direction crossing conveying.

The aligning means include an alignment plate which moves by engaging rotors such as a roller or the sheets at their ends.

Therefore, conventionally, the sheets delivered on the process tray are moved by the conveying means toward a restraining stopper, at the same time, moved by the aligning means in the direction perpendicular to the conveying direction crossing by the conveying means, and set for positioning to the restraining stopper.

Since a prior art actuates the conveying means and the aligning means on the sheets concurrently, the prior art has a problem of causing bent at a corner of a sheet or skew, when colliding with the restraining stopper.

This condition is illustrated in FIG. 11, and the conveying force F1 acts in a conveying direction (the shown direction is opposite to a sheet discharge direction) by a first conveying means 50, and at the same time, the conveying force F2 acts in a direction crossing the conveying direction by an aligning means 51. When the sheets concurrently effected with the conveying force F1 and F2 collide with the restraining stopper 52, reaction F3 is generated in the illustrated oblique lines from the restraining stopper. This reaction F3 acts on the sheets as a manner of balancing the conveying force F1 and F2.

In case, therefore, resultant force of the conveying forces F1 and F2 is large, reaction F3 balanced therewith is also large. As a result, the sheets are bent at the illustrated oblique part and it causes the bent sheet ears.

When the sheet bent at a corner occurs in the sheet, the sheet is skewed as a whole, and this skew affects the post process such as the staple binding.

In particular, if the sheet sizes are different in width as shown and in case of the large sized sheet La, the reaction F3 acts over the large area of the slash portion La1 by the above mentioned conveying forces F1 and F2, while in case of the sheet Lb of the small size, the reaction F3 acts in the small area of the slash portion. Accordingly, when designing the apparatus, if the conveying forces F1 and F2 are determined in response to the sheet La of the large size, the sheet bent at the corner easily occurs in case the sheets have the small size.

Contrary thereto, when designing the apparatus, if the conveying forces F1 and F2 are determined in response to the sheet of the small size, the large sized sheets do not receive the conveying force and are not completely sent, resulting in positioning under a resist condition.

In the present invention, therefore, it is an object to provide a sheet aligning apparatus which neither causes corner edge-bending or skewing at the sheet ends when pushing the sheets to regulate them on the process tray by colliding the sheets with the restraining member, and at the same time, nor regulate the sheets under the condition of creating the resist condition or non-reaching portions of the sheet end to the restraining stopper.

Further, it is another object to provide a post processing device which enables to perform the post process to the right position of the sheet when carrying out the post process to the sheets piled on the process tray, and provide an image forming apparatus having the post processing device.

Further objects and advantages of the invention will be apparent from the following description of the invention.

SUMMARY OF THE INVENTION

For accomplishing the above mentioned objects, the present invention has the following structures.

The apparatus comprises conveyance means of actuating conveyance force to move the sheets to the side of the restraining stopper, when pushing to align the sheets conveyed on the process tray by colliding the sheets with the restraining stopper, and aligning means of moving the sheets in a direction crossing the conveying direction of the conveyance means. The conveyance means is constructed with, for example, rollers contacting an uppermost sheet of the sheets on the processing sheet, while the aligning means is constructed with, for example, a regulating plate of pushing to move the sheet sides.

Therefore, the conveyance means is moved between an operating position of pressing the uppermost sheet on the process tray at predetermined pressure and a non-operating position of reducing this pressure, or the non-operating position of separating upward from the uppermost sheet. Also, shifting means is furnished for shifting the conveyance means between the operating position and the non-operating position.

Control means is structured as follows for controlling the conveyance means, the shifting means and the aligning means. The control means (1) starts a sheet discharge means to move the sheets discharged on the tray means toward a restraining stopper member, then (2) operates the aligning means after a predetermined time to move the sheets for regulating the sheet sides, and subsequently (3) operates the sheet discharge and conveyance means under the condition of stopping the aligning means, and controls to collide the sheets with the restraining stopper.

The control means is so structured as to control the shifting means for reducing or removing the pressure exerting between the sheets and the sheet discharge means when moving the sheets for regulating the sheet sides.

With this structure, the sheets on the process tray are sent to the side of the restraining stopper by the conveyance means. When the aligning means is operated under the condition of shifting the conveyance means to the non-operating position, the sheets move in the direction crossing the conveying direction, and the sheet sides are positioned at the standard position. Under the condition of positioning the sheets, the aligning means is stopped and the conveyance means is operated, so that the sheets collide with the restraining means.

Accordingly, after the sheets are positioned by the aligning means in the direction crossing the conveying direction, the sheet ends are collided with the restraining stopper by the conveyance means. Accordingly, the sheets are not created with the corner bent portion or skewing, and the problem of resist is solved.

BRIEF DESCRIPTION OF THE DRAWINGS

FIG. 5(*a*) is an explanatory view of an operating condition of the aligning means, FIG. 5(*b*) is an explanatory view of an operating condition of the sheet discharge means, and FIG. 5(*c*) is an explanatory view of an operating condition of the sheet discharge means.

DETAILED DESCRIPTION OF THE PREFERRED EMBODIMENTS

Figure 1:
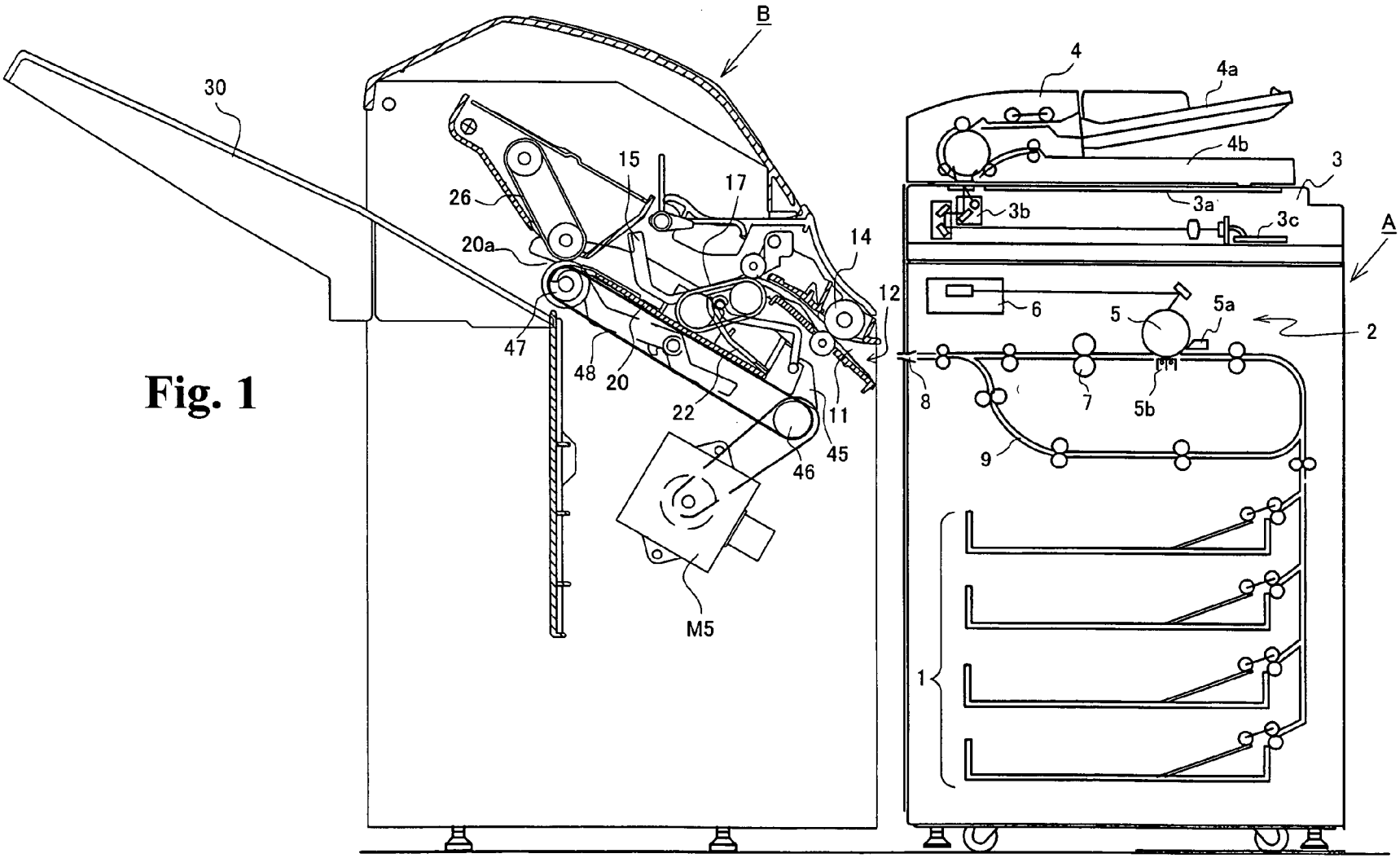
FIG. 1 is an explanatory view of the whole structures of the post processing apparatus and the image forming apparatus according to the present invention.
Figure 2:
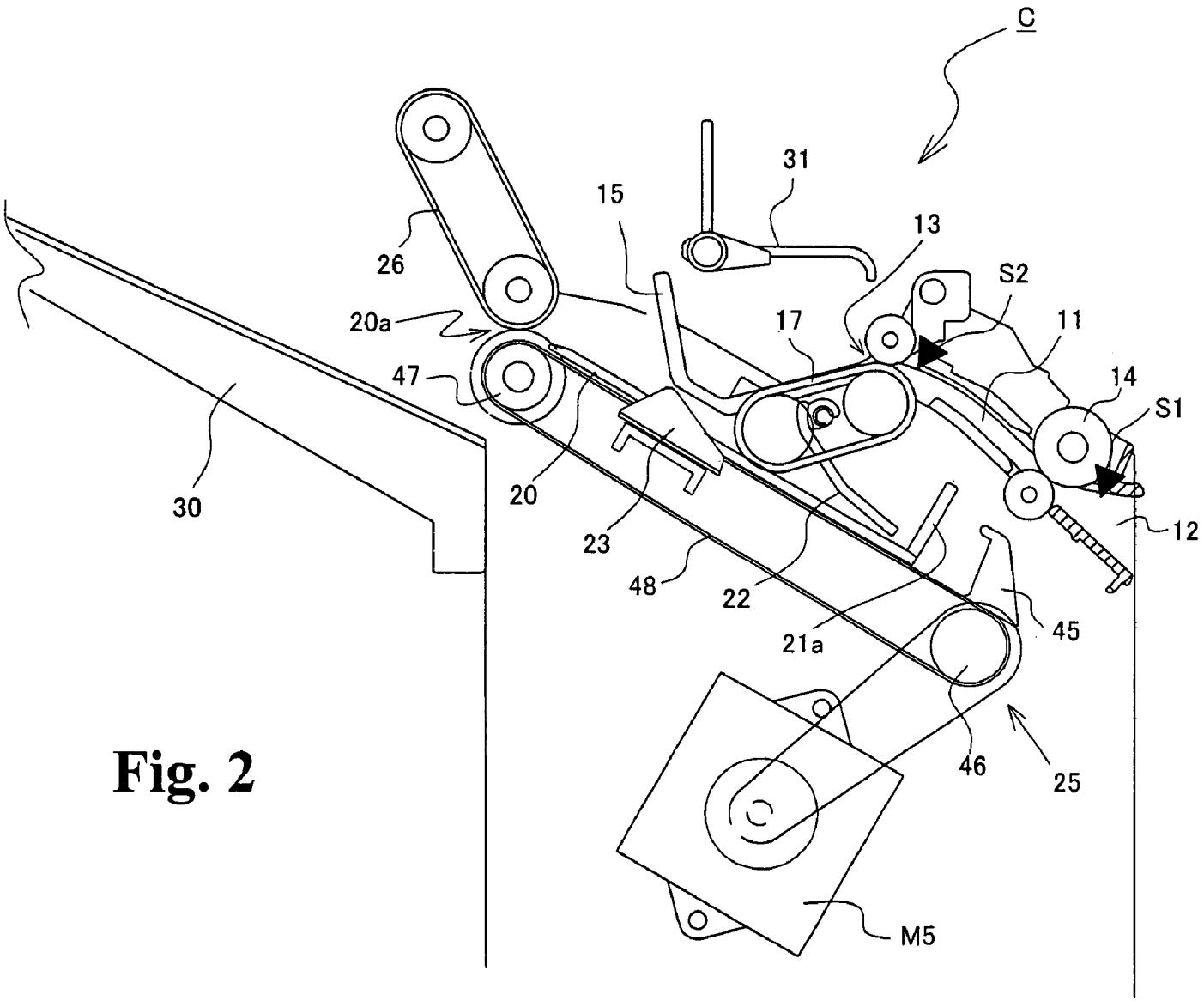
FIG. 2 is an explanatory view showing the sheet aligning part in FIG. 1.

Based on the under illustrated embodiments, the present invention will be referred to in detail. FIG. 1 is the explanatory views of the whole structure of the system having the post processing apparatus incorporating therein the sheet aligning apparatus according to the present invention and the image forming apparatus of delivering the sheets to the post processing apparatus, and FIG. 2 is the explanatory view of enlarging the elementary part of the post processing apparatus. In the following description, explanation will be made in order of "the image forming system", "the post processing apparatus" and "sheet aligning apparatus".

[Image Forming System]

The image forming system shown in FIG. 1 is structured with the image forming apparatus A and the post processing apparatus B, and the post processing apparatus B is incorporated with the sheet aligning apparatus C. The image forming apparatus A is composed of a sheet feeding stacker 1, an image forming portion 2 of forming images on the sheets from the sheet feeding stacker 1, a scanner portion 3 and an original document sending portion 4. The image forming portion 2 is composed of an electrostatic print station, an ink jetting print station, and an offset print station in order to carry out duplication postings of image data optically read out by the scanner portion 3 in the sheet from the sheet feeding stacker 1. The shown one is the electrostatic printing station, and around a photoconductor drum 5, there are disposed a developing machine 5*a*, a charger 5*b* and a printing head 6. On the photoconductor drum 5, an electrostatic latent image is formed by the printing head 6, adhered with a toner ink by the developing machine 5*a* and transfer-printed on the sheet by the charger 5*b*. The sheets transferred with the toner ink are fixed by a fixing unit 7 and transferred from the sheet outlet 8 in order. A part 9 is a circulation route, which again sends the sheet printed on an upper surface to the photoconductor drum 5 and forms imaged on a back surface to have the both surfaces printed.

In addition, the scanner portion 3 comprises a platen 3*a* mounting the original document thereon, a reading carriage 3*b* of scanning the image of the original document in line order along the platen 3*a*, and a photoelectric conversion sensor 3*c*. Further, an original document sending portion 4 is mounted above the scanner portion 3 in order to separate the documents mounted and set on a document tray 4*a* sheet by sheet, send them to the platen 3*a* and store on a delivery tray 4*b*. As to others, the image data is transferred to the printing head 6 from an external image forming apparatus, for example, a computer. Based on the data, a function of a network printer of forming images on the sheet is also furnished.

[Post Processing Apparatus]

The post processing apparatus B according to the present invention is connected to the sheet outlet 8 of the image forming apparatus A, successively receives the sheets formed with images and carries out "sheet stitching treatment", "jog treatment" and "sheet discharge (storing) treatment". The image forming system is, therefore, composed of the image forming apparatus main body having a copying apparatus—a printing function—a facsimile function, and the post processing apparatus connected thereto. The post processing apparatus B has, as the operation modes, a series of the processing operations such as a sheet stitching treatment of binding the set copies of the sheets having the formed images in order of pages, or the jog treatment of dividing and storing the sheets under binding the set copies when discharging and storing the sheets.

With respect to the controls of the respective operation modes, at the image forming apparatus A, an operator determines the post processing modes such as the "sheet binding treatment", "jog treatment" and "sheet delivery (storing) treatment" at the same time as the printing modes such as the number of copies or the printing function, and in accordance with command signals from the image forming apparatus A, the post processing apparatus B executes performances in response to the respective operation modes.

The post processing apparatus B is, therefore, structured of a sheet outlet route 11 of receiving the sheets discharged successively from the image forming apparatus A and delivering to the downstream side, a process tray 20 disposed under the sheet outlet 13 of the sheet outlet route 11, and the storing stacker 30 disposed at the downstream side of the process tray 20. The process tray 20 is incorporated with "sheet aligning apparatus". The sheet outlet route 11 is provided with a conveyance roller 14 of conveying the sheets sent toward a sheet inlet 12, and this conveyance roller 14 comprises a pair of rollers pressing each other. Further, the sheet outlet route 11 is provided with an inlet sensor S1 for detecting the front and rear ends of the conveyed sheet.

Therefore, the sheets from the image forming apparatus A are guided by the sheet outlet route 11 and sent to the sheet outlet 13 by the conveyance roller 14. Under the sheet outlet 13, a stepwise difference is formed in order to dispose the process tray 20 for temporarily mounting to support the sheets, and under this condition, the post processing is performed on the sheet. The process tray 20 is incorporated with a mechanism in response to the post processing function to the sheets, and the illustrated process tray 20 is equipped with "the sheet stitching function", "the jog function", and "the sheet conveying function" for conveying the sheets from the sheet outlet 13 to the storing stacker 30 at the downstream.

The "sheet stitching function" piles, in the order of pages, sheets sent from the image forming apparatus A on the process tray 20, performs the staple stitching, conveys and stores the stack of the treated sheets to the storing stacker 30. The "jog function" divides the sheets delivered from the image forming apparatus A and stores them into the storing stacker 30 for binding the set copies. The process tray 20 has, therefore, a jog shift function of shifting the sheets of the determined amounts in a direction crossing the conveying direction. With respect to the illustrated jog shaft function, the aligning means 23 serves this function. The "sheet conveyance function" successively conveys the train of sheets delivered from the image forming apparatus A onto the storing stacker 30, not performing the post-process on the process tray 20. Therefore, a reciprocally delivering roller 26 is disposed on the process tray 20.

Figure 3A:
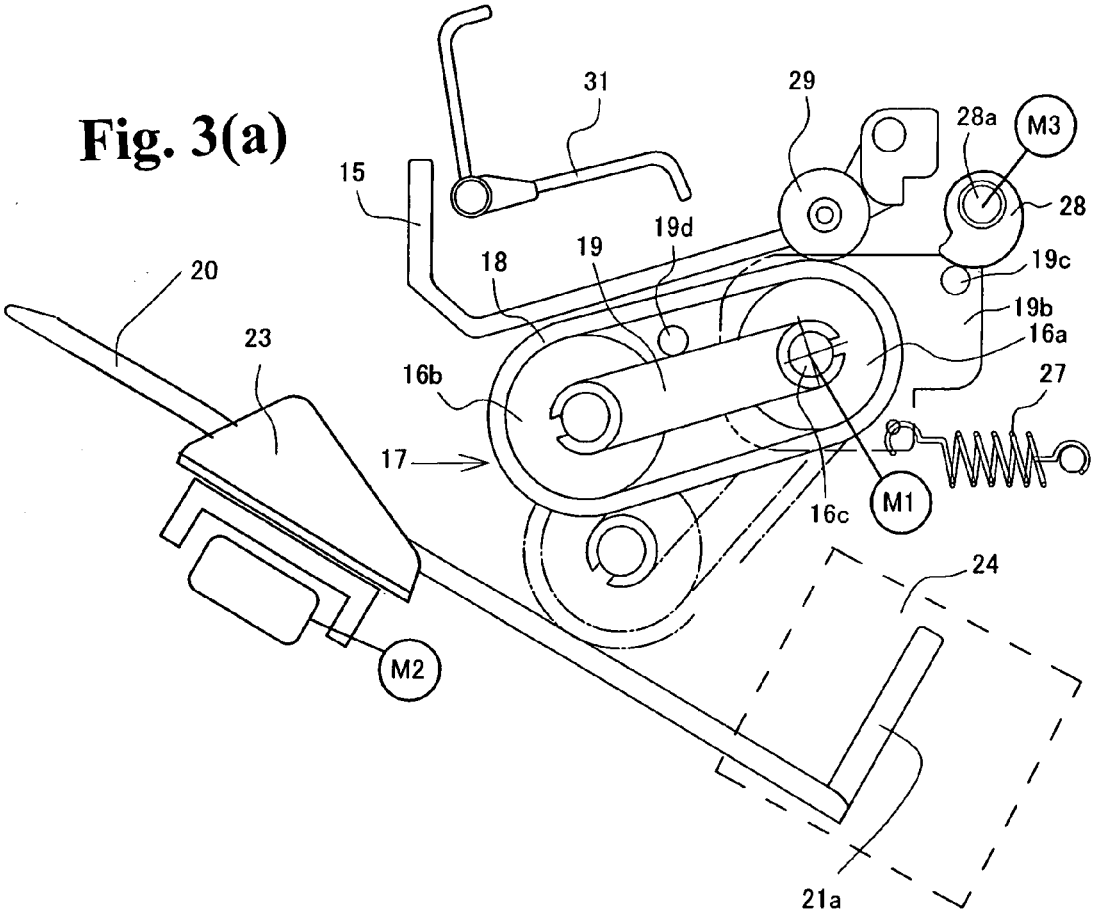
FIG. 3(*a*) shows the structure of belt moving means (sheet conveyance means), and FIG. 3(*b*) shows the structure of an aligning means.
Figure 3B:
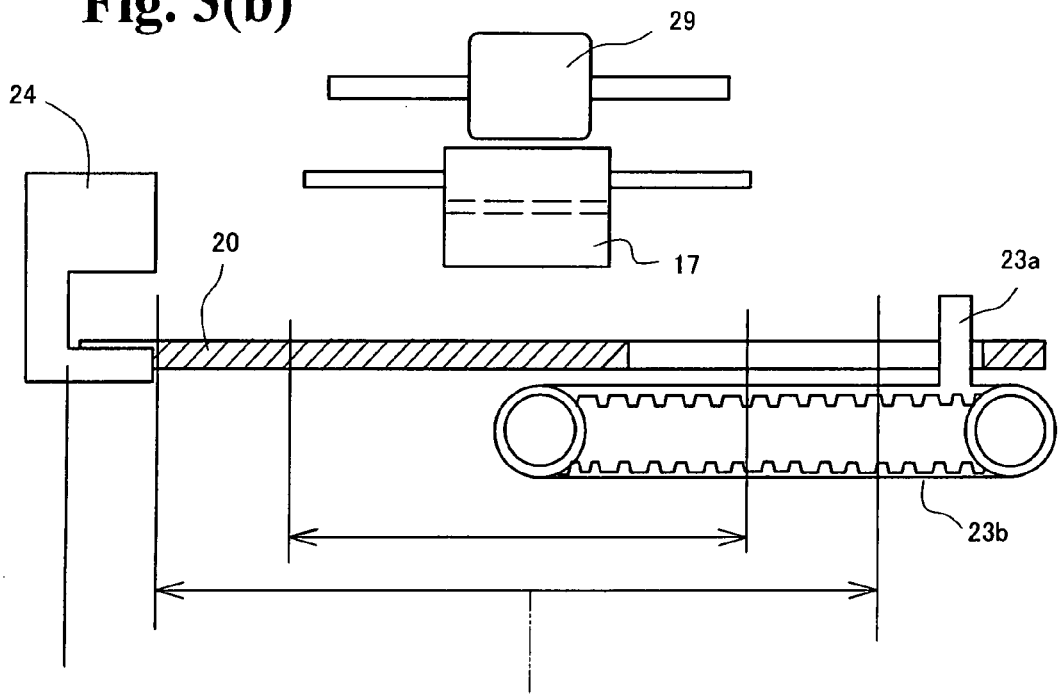
Figure 10A:
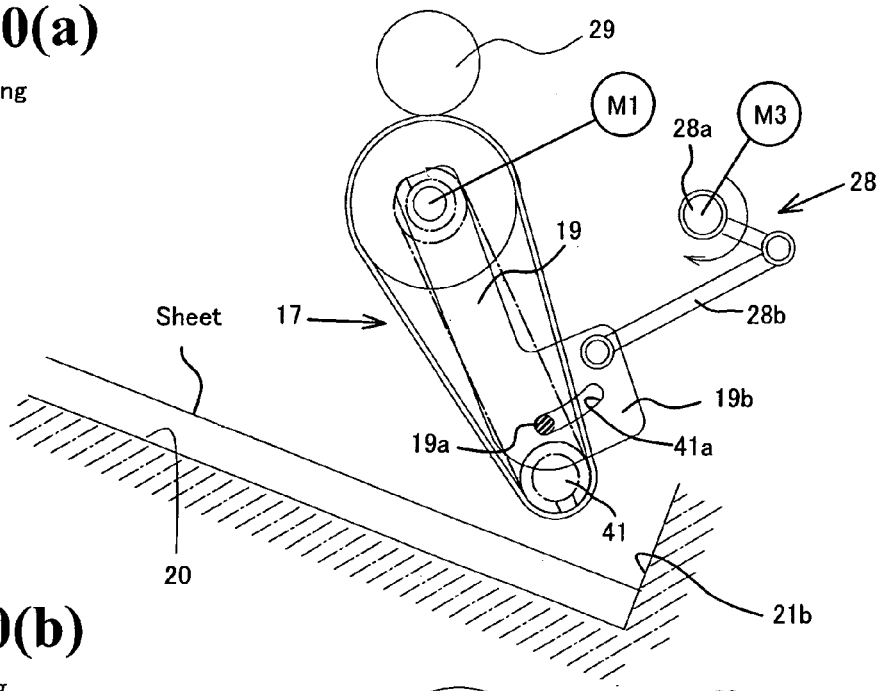
FIGS. 10(*a*), 10(*b*) and 10(*c*) are explanatory views of showing the embodiments different from that of FIG. 3, wherein FIG. 10(*a*) shows a condition where the belt delivering means is moved to the retreating position, FIG. 10(*b*) shows a condition where the belt delivering means is moved to the operating position, and FIG. 10(*c*) shows a condition where the belt delivering means is moved to the operating position by belt's own weight.
Figure 10B:
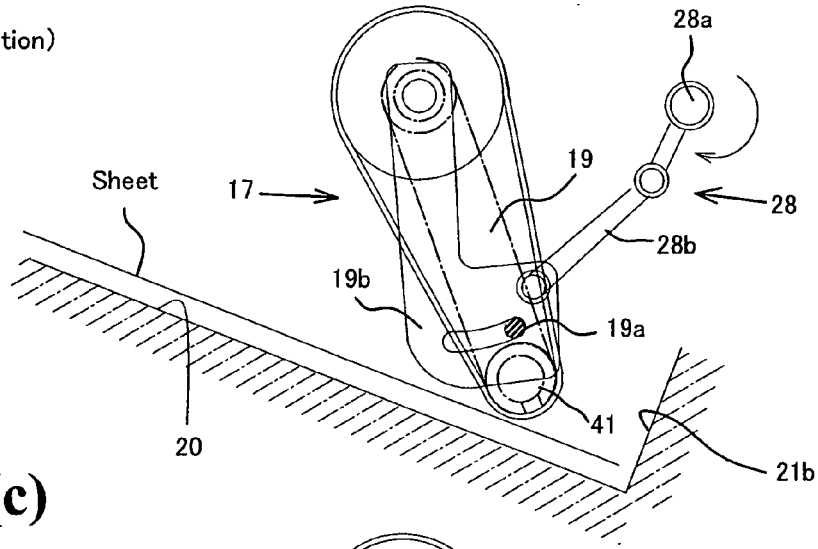
Figure 10C:
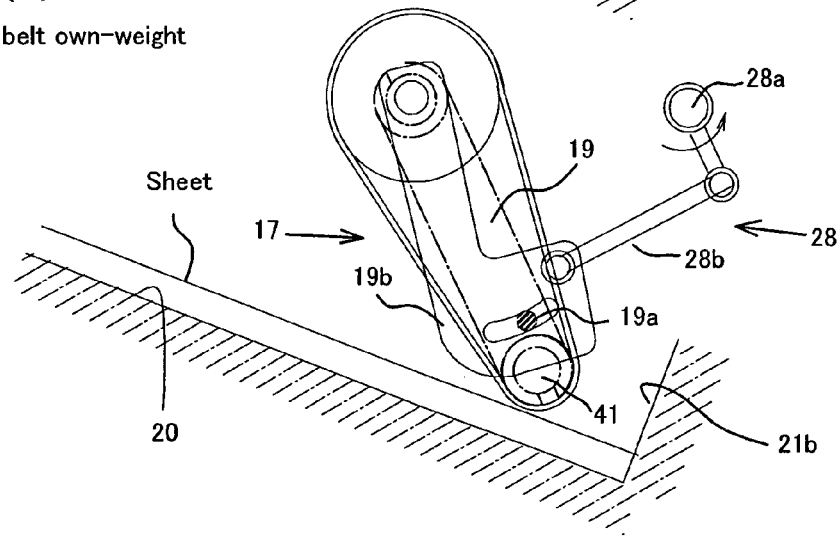
Figure 11:
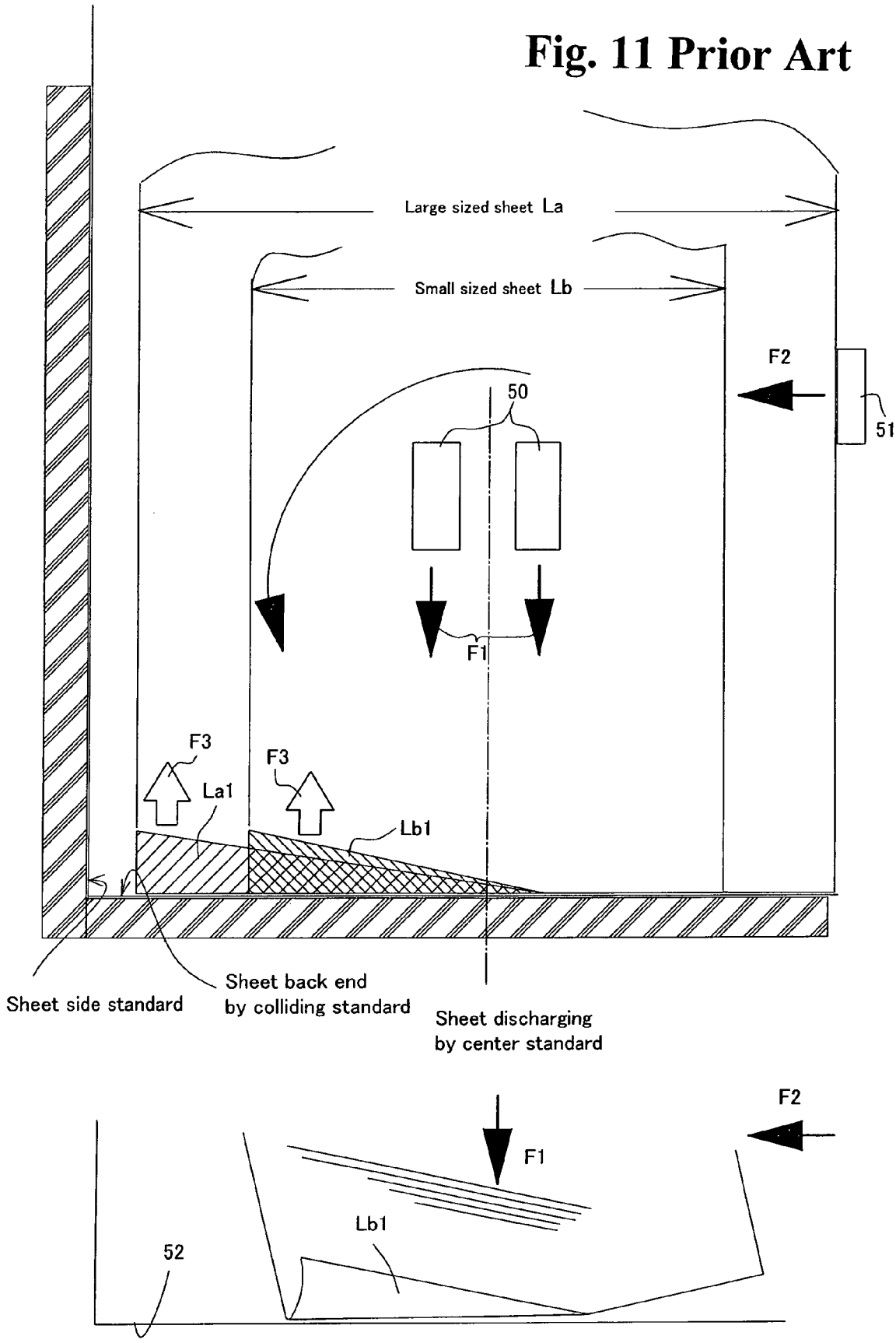
Fig. 11 Prior Art
FIG. 11 is an explanatory view of the sheet aligning condition in a conventional apparatus.

The process tray 20 is furnished with a staple means 24 (the post processing means; shown in FIG. 3(*b*)), a sheet end regulating member 21*a* of positioning and aligning the sheets at the post processing position, and a side regulating member 21*b* (shown in FIG. 10). A regulating stopper 21*a* projects upward from the process tray 20 for causing front sheet ends or back ends in the sheet delivering direction to collide therewith and regulate them. Similarly, the side regulating member 21*b* projects upward from the process tray 20 for causing sheet side ends in the direction crossing the sheet delivering direction to collide therewith and regulate them. The side regulating member 21*b* forms, as later mentioned, a collision standard when moving to regulate the width ends of the sheets delivered on the process tray 20 with the center standard at a process position disposed with the staple means 24 (the post processing means).

The process tray 20 is furnished with belt delivering means 17 of guiding the sheets from the sheet outlet 13 onto the tray, the reciprocally rotating delivery roller 26 of delivering the sheets on the process tray 20 to the downstream side and then switching them back to the upstream side, sheet discharging and delivering means 17 (a shown one is served by the above mentioned belt delivering means) of delivering the sheets on the process tray 20 toward the sheet end regulating member, and aligning means 23 of delivering the sheets on the process tray 20 toward the sheet side regulating means 21*b*.

At first, belt delivering means 17 (the sheet discharging and delivering means; the same in the following) is, as shown in FIGS. 2 and 3(*a*), formed by bridging a caterpillar belt 18 between a pair of pulleys 16*a* and 16*b*, and is disposed along the sheet delivering direction between the sheet outlet 13 and the process tray 20. The belt delivering means 17 is so structured that the sheets are brought from the sheet outlet 13 by a belt upper half portion 18*a* (the slack side) onto the process tray 20, and the sheets brought on the process tray 20 are moved toward the regulating stopper 21*a* by a belt lower half portion 18*b* (the tensile side). Therefore, the pulley 16*a* (called as "stationary pulley" hereafter) placed at the side of the sheet outlet 13 is secured to an apparatus frame, and a rotating shaft 16*c* is connected with a drive motor M1 to rotate in a counterclockwise direction.

On the other hand, another pulley 16*b* (movable pulley) is supported by a rocking arm member 19 pivoted by the rotating shaft 16*c* of the stationary pulley 16*a*, and the caterpillar belt 18 (called briefly as "belt" hereafter) is bridged in relation with the stationary pulley 16*a*. Accordingly, the movable pulley 16*b* vertically moves integrally together with the belt 18 winding therewith, and the rocking arm member 19 is provided with an urging spring 27 and shift means 28.

The rocking arm member 19 is furnished integrally with a connecting plate 19*b* which is bridged with an urging spring 27 in relation with the apparatus frame for always urging the movable pulley 16*b* to the side of the process tray 20. Further, the connecting plate 19*b* includes a cam pin 19*c* with which shift means 28 made of an eccentric cam is engaged in order to retreat the movable pulley 16*b* above the process tray 20 against the urging spring 27. Reference numeral 19*d* designates a regulating stopper. In the shift means 28 consisting of the eccentric cam, the rotating shaft 28*a* is connected with a control motor M3 on the rotating shaft 28, and when the shift means 28 engages at its cam face the cam pin 19*c*, the movable pulley 16*b* is positioned at a non-operating position above the process tray 20, and when the cam pin 19*c* separates from the cam face, the movable pulley 16*b* moves to an operating position pressing an uppermost sheet on the process tray 20 by force of the urging spring 27. As long as the shift means 28 is such a mechanism which vertically moves between the operating position of pressing the movable pulley 16*b* to the uppermost sheet on the process tray 20 and the non-operating position of retreating the movable pulley 16*b* from the sheet, various kinds of structures are available, irrespective of the eccentric cams.

The belt delivering means 17 is pressed with the pinch roller 29 at the side of the sheet outlet, and is arranged with the guide plate 15 in a manner as rocking on the upper half portion 18*a* of the belt. Reference numeral 31 designates a sheet raking paddle composed of flexible blade members. The process tray 20 is arranged with the reciprocally rotating roller 26 and sends the sheets delivered on the process tray 20 to the downstream side, and supports as bridging the sheets between a later mentioned storing stacker 30 and the process tray 20. In short, the sheets from the sheet outlet 13 are supported at the front ends by the storing stacker 30 and supported at the back ends by the process tray 20. Therefore, the reciprocally rotating roller 26 is supported in such a manner as to vertically rock with respect to the process tray, and is connected to the drive motor so as to rotate in both normal and reverse directions.

The belt delivering means 17 serves also as sheet discharging and delivering means of delivering the sheets on the process tray 20 toward the regulating stopper 21*a*. The shown one delivers the sheets on the process tray 20 by the belt delivering means 17 toward the regulating stopper 21*a*, and sheet pressing means 22 is arranged for avoiding the sheet front ends from deflecting owing to such as curling. The sheet pressing means 22 is an elastic pressing plate (weight member) contacting an uppermost sheet of the sheets on the process tray 20, and turnably suspends onto the process tray 20.

The thus structured process tray 20 is disposed with the post processing means (shown in FIGS. 3(*a*) and 3(*b*)), and the illustrated one shows the staple apparatus 24. The sheets are delivered from the sheet outlet 13 at the center standard, and after delivering the sheets on the process tray 20 by the belt delivering means 17 and the reciprocally rotating roller 26, the sheets advance at the back ends onto the process tray 20, and then, when the reciprocally rotating roller 26 reversely rotates to switch back the sheets, the sheets advance to the lower half portion 18*b* of the belt. Then, the sheets collide at their back ends with the regulating stopper 21*a* by means of the sheet discharging and delivering means composed of the belt delivering means 17. There is provided the aligning means 23 at the process tray 20 for aligning to the post processing position the sheets at this time delivered in the crossing direction under the center standard.

The aligning means 23 is disposed on the process tray 20 with the sheet movable in the direction crossing the sheet conveyance, and has a mechanism, for example, shown in FIG. 3(*b*). The process tray 20 is disposed at the back side with a belt 23*b* movable in the direction crossing the sheet conveyance. The belt 23*b* reciprocates at a predetermined stroke by a motor (not shown), and is fixed with a registering plate 23*a* engaging the sheet sides. The aligning plate 23*a* projects with respect to the process tray 20, and moves in the direction crossing the sheet conveyance for moving the sheets by a predetermined amount.

The belt delivering means 17 and the guide plate 15 form a pair at an appropriate space in a sheet width direction (the direction crossing the delivery direction, and the same in the following), so that the guide plate 15 is placed in relation with the belt delivering means 17. The process tray 20 is disposed with a sheet pushing means 25 as later mentioned in order to deliver the post-treated sheets to the storing stacker 30 at the downstream side. The process tray 20 is provided at the center in the sheet width direction with a guide groove (not shown) for a sheet pushing pawl 45 to move therein, and the pushing pawl 45 delivers, along the guide groove, the sheets placed at the regulating stopper 21*a* at the downstream side to an eject opening 20*a* at the upstream side. Therefore, a belt member 48 is bridged between a pair of pulleys 46 and 47 furnished at the back side of the process tray 20, and is secured integrally with the pushing pawl 45. The pulley 46 is connected with a motor M5 for driving the sheet pushing pawl 45. Thus, the pushing pawl 45 swirls by the drive motor M5 in a manner of going around the process tray 20. Similarly to the sheet pushing pawl 45, the eject opening 20*a* is equipped with a reciprocally delivering roller 26 of the above mentioned mechanism.

[Storing Stacker]

Figure 4:
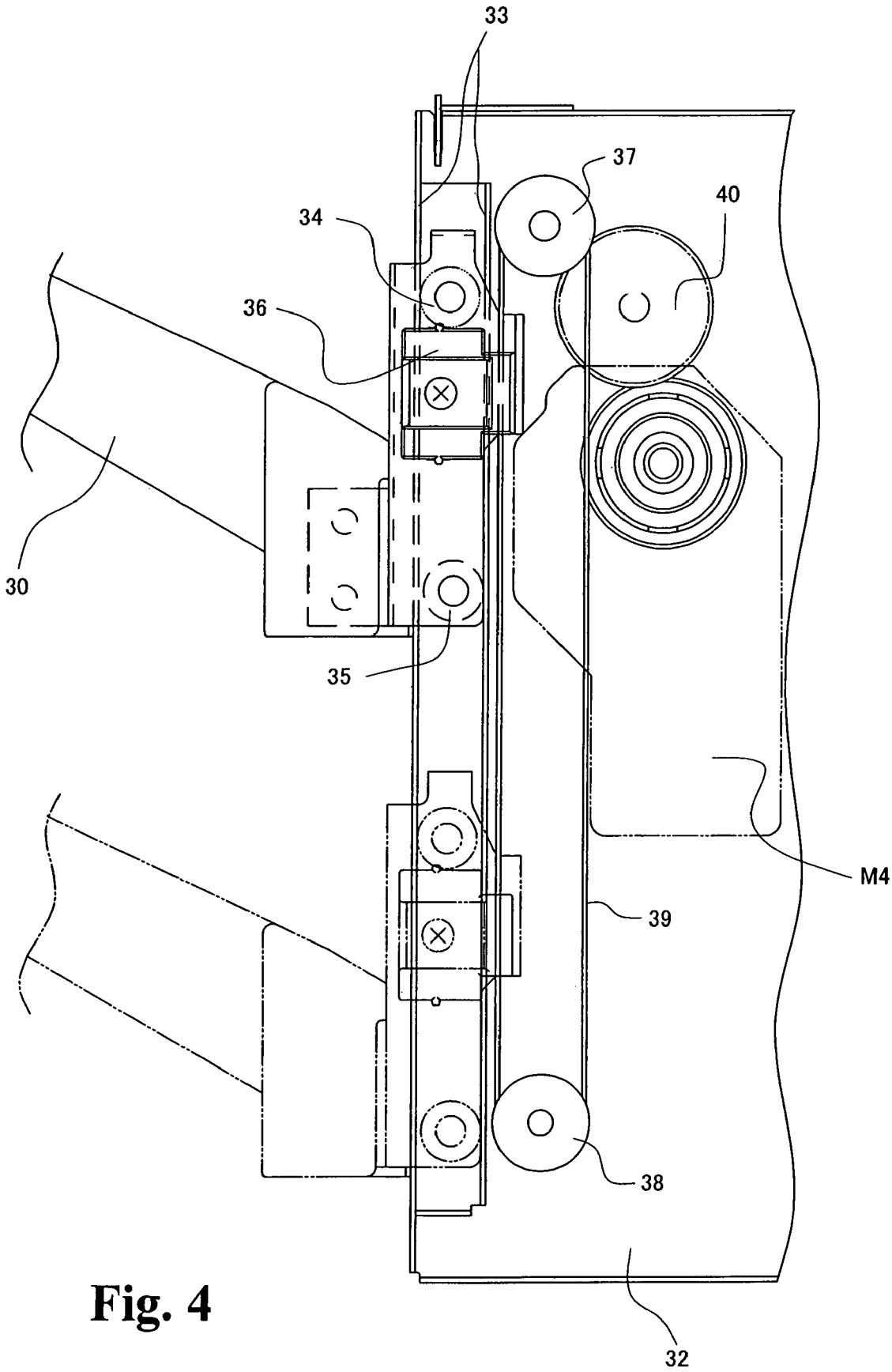
FIG. 4 is an explanatory view showing the structure of a storing stacker.

Explanation will be made to the structure of the storing stacker 30 disposed at the downstream side of the process tray 20. As shown in FIG. 4, the storing stacker 30 is furnished to the apparatus frame 32 to move vertically so that the uppermost sheet of the mounted sheets is positioned at the eject opening 20*a* of the process tray 20. The apparatus frame 32 is provided with guide rails 33 following in the sheet mounting direction, and rollers 34, 35 fitted on the guide rails 33 are attached to the stationary member 36 of the storing stacker 30.

The storing stacker 30 is, therefore, supported by the rollers 34, 35 integrally therewith in a manner of vertically moving along the guide rails 33. The apparatus frame 32 is provided with a pair of vertical pulleys 37, 38 and an elevating belt 39 bridged between the vertical pulleys 37 and 38, and the elevating belt 39 is fixed at its one part with the stationary member 36. One of the pulleys 37, 38 is connected to an elevating motor M4 by a transmission gear 40, so that the storing stacker 30 is vertically driven by the elevating motor M4.

On the other hand, there is provided an upper limit sensor (not shown) above the storing stacker 30, and the elevating motor M4 gradually moves down the storing stacker 30 in response to the sheet mounting amount such that the uppermost sheet of the sheets on the storing stacker 30 is positioned at the upper limit sensor, and when the sheets on the storing stacker 30 is taken out, the tray is moved up at its upper surface to the position of the upper limit sensor. Incidentally, in the present invention, it is sufficient to fix the storing stacker 30 to the apparatus frame, not vertically moving as illustrated.

In the present invention, therefore, the sheets from sheet outlet 13 are stored onto the process tray 20 structured as mentioned above at the regulating stopper 21*a* and the side regulating member 21*b* as mentioned below. With respect to the process tray 20, the sheet discharging and delivering means 17 (belt delivering means) delivers the sheets on the process tray 20 toward the regulating stopper 21*a* (regulating stopper). In addition, the aligning means 23 arranged on the process tray 20 delivers the sheets in the direction crossing the delivering direction. The belt delivering means 17 and the aligning means 23 are respectively connected with the drive motors M1, M2. In the belt delivering means 17, the shift means 28 is structured with the eccentric cams and its control motor M3, the shift means 28 performing a positioning movement between the operating position of pressing the sheets on the process tray 20 and the non-operating position. These drive motors M1, M2, M3 are controlled by a control means 50 composed of a control CPU.

[Delivery of Sheet onto the Process Tray]

Figure 7:
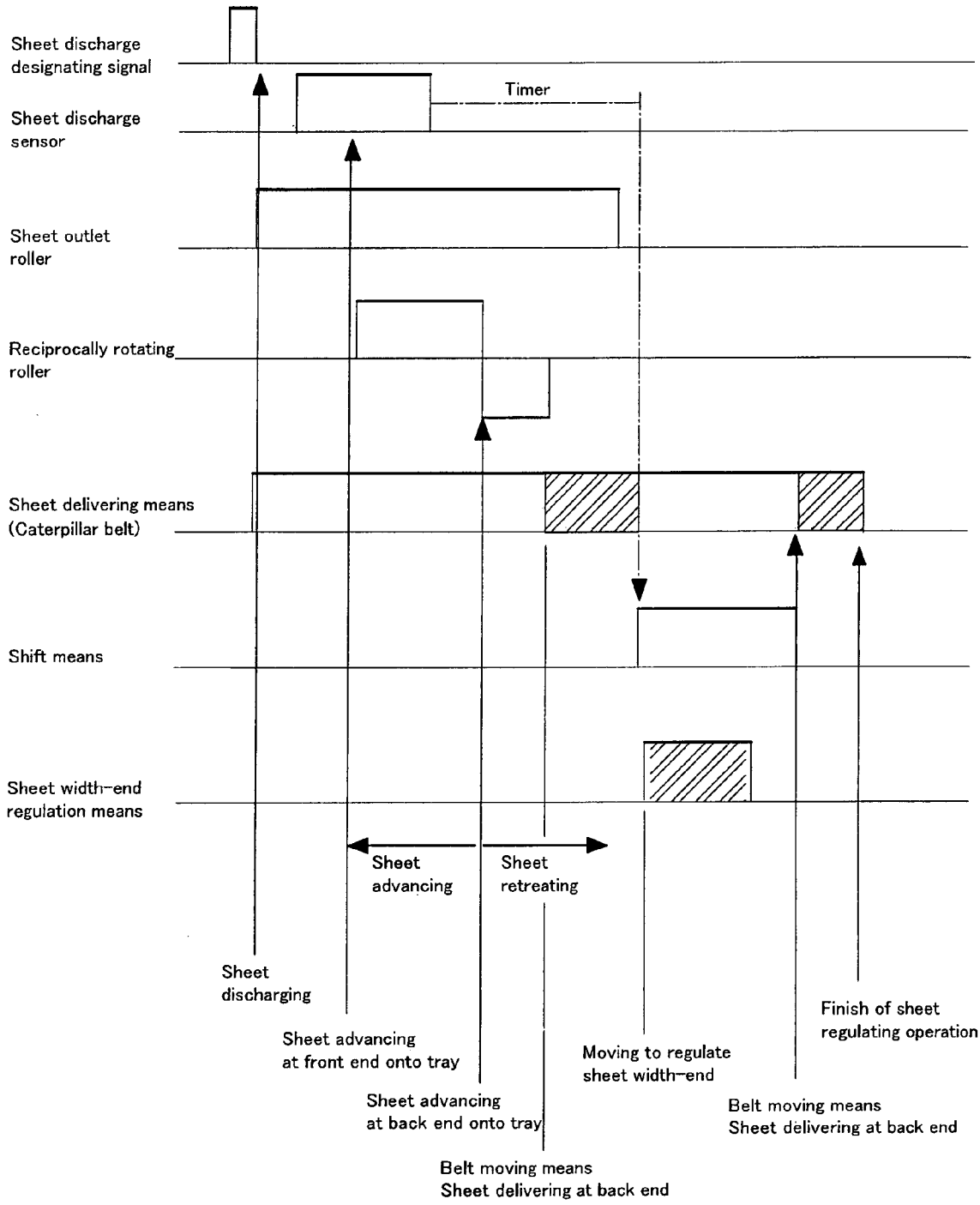
FIG. 7 is timing charts of the embodiment of FIG. 3.

As illustrated in FIG. 7, the control means 50 receives a sheet outlet designating signal, moves the belt delivering means 17 under the condition of FIG. 5(*b*) to a non-operating position of retreating from the sheets on the process tray 20, moves the reciprocally rotating roller 26 to a waiting position retreating from the sheets on the process tray 20, and at the same time rotates the drive motors M1, M2 in the sheet outlet direction. At this time, the control means 50 holds the aligning means 23 at a waiting position Wp separating from a largest sheet on the process tray 20 under the condition of FIG. 5(*a*). Under this condition, the sheets from the delivering roller 14 are sent to the sheet outlet 13, nipped between the pinch roller 29 and the belt upper half portion 18*a*, and sent to an arrow direction of the same. Then, the guide plate 15 guides the sheets upward of the process tray 20.

Subsequently, a sheet outlet sensor S2 detects the sheet at its front end, and after an estimate time of reaching a front end of the sheet to the reciprocally rotating roller 26, the control means 50 moves the reciprocally rotating delivering roller 26 from the retreating position to the operating position of colliding with the delivering sheet on the process tray 20, and rotates this roller in the counterclockwise direction. Then, the sheets are drawn into the process tray 20 and the storing stacker 30 by the reciprocally rotating delivering roller 26 and the belt delivering means 17, and supported as bridged by both trays.

[Switch Back Reverse and Transfer of the Sheet]

The control means 50 reverses the reciprocally rotating roller in the counterclockwise direction after the apparent time when the discharge sensor S2 detects the sheet at its back end and the sheet back end is delivered onto the process tray 20, and the paddle is rotated in the counterclockwise direction. At the same time, the belt delivering means 17 goes down to the operating position. The belt delivering means 17 is moved by rotating the control motor M3 to separate the eccentric cam 28 (shift means) from a cam pin 19*c*. Then, the belt delivering means 17 moves to an operating position where the rocking arm member 19 receives an effect from the action of the urging spring 27 and collides with the uppermost sheet of the sheets on the process tray 20 under the condition of FIG. 5(*c*). At this time, the aligning means 23 is held at the waiting position Wp of FIG. 5(*a*). Accordingly, the sheets delivered onto the process tray 20 reverse in the delivering direction, the sheet back ends move toward the sheet regulating member 21*a*, and the paddle 31 guides the sheet back ends going into between the belt lower half portion 18*b* of the belt delivering means 17 and the process tray 20.

After the estimate amount of time for delivering the sheet back end to the belt delivering means 17 of the operating position, the control means 50 moves the reciprocally rotating means 26 to the reprocess position above the process tray 20. Then, the sheets collide at the back ends with the regulating stopper 21*a* under the condition of FIG. 5(*c*).

[Sheet Width Regulation]

Figure 6A:
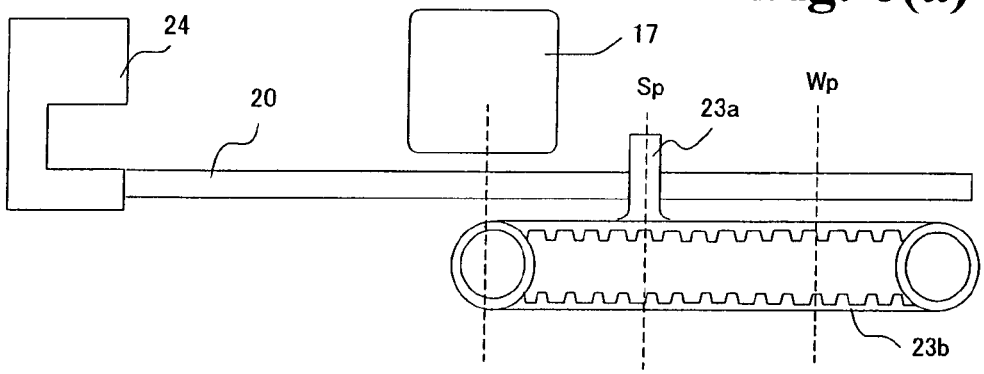
FIG. 6(*a*) is an explanatory view of an operating condition of the aligning means, FIG. 6(*b*) is an explanatory view of an operating condition of the sheet discharge means, and FIG. 6(*c*) is an explanatory view of an operating condition of the sheet discharge means.
Figure 6B:
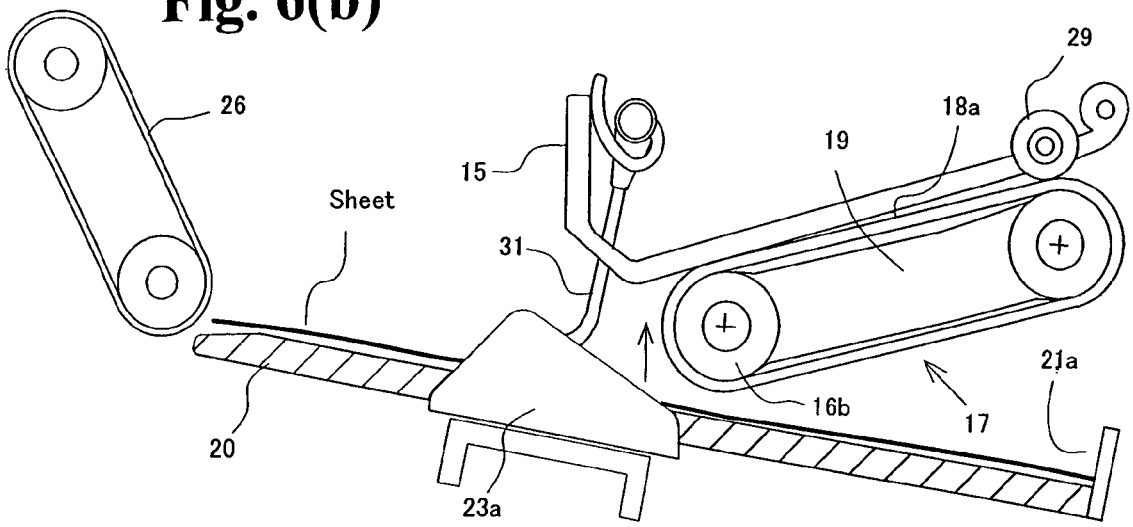
Figure 6C:
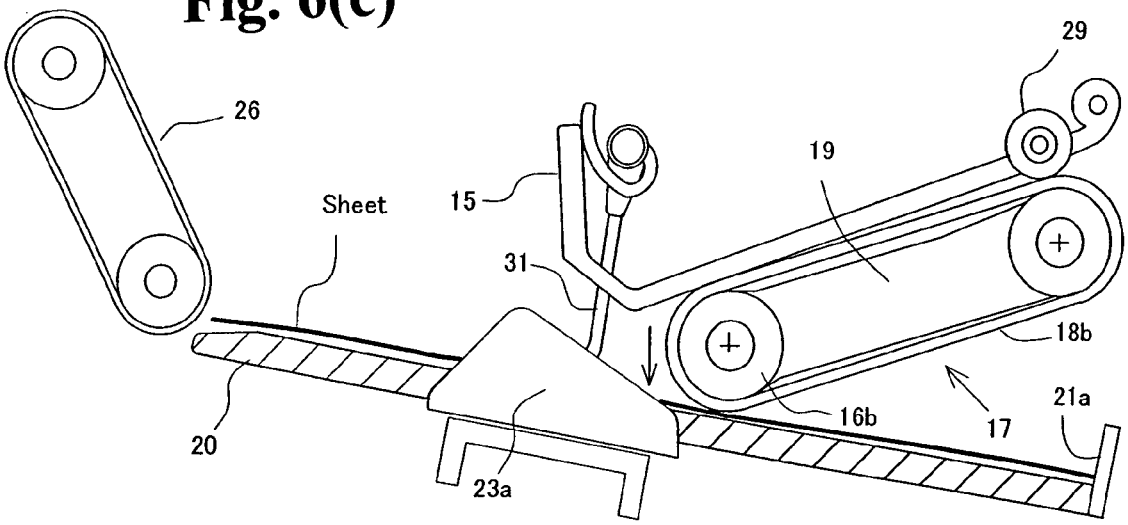

After, or immediately before the sheets collide at the back ends with the regulating stopper 21*a*, the control means 50 causes the shift means 28 to operate the belt delivering means 17 to move to the non-operating position as shown in FIG. 6(*b*). The sheets on the process tray 20 are released from the belt delivering means 17, and laid under a condition that the sheet back ends are regulated to the regulating stopper 21*a*. The control means 50 operates the drive motor M2 of the aligning means 23 and moves an aligning plate 23*a* toward the sheet side regulating member 21*b*. Then, the sheets move on the process tray 20 in the direction crossing the delivering direction and collide with the sheet side regulating member 21*b* as shown in FIG. 6(*a*).

[Collision and Alignment of the Sheets Regulating Member]

After moving the aligning plate 23*a* to the predetermined positioning in the sheet width direction, the control means 50 causes the shift means 28 to return the belt delivering means 17 to the operating position. At this time, the belt delivering means 17 rotates in the sheet discharging direction (the counter clockwise direction). Then, the belt delivering means 17 moves the sheet as colliding with the control stopper 21*a* as shown in FIG. 6(*c*), so that the sheets are positioned and aligned along the regulating stopper 21*a*. After the estimate amount of time of exactly aligning the sheets at the back ends to the control stopper 21*a*, the control means 50 stops the drive motor M1.

Figure 9:
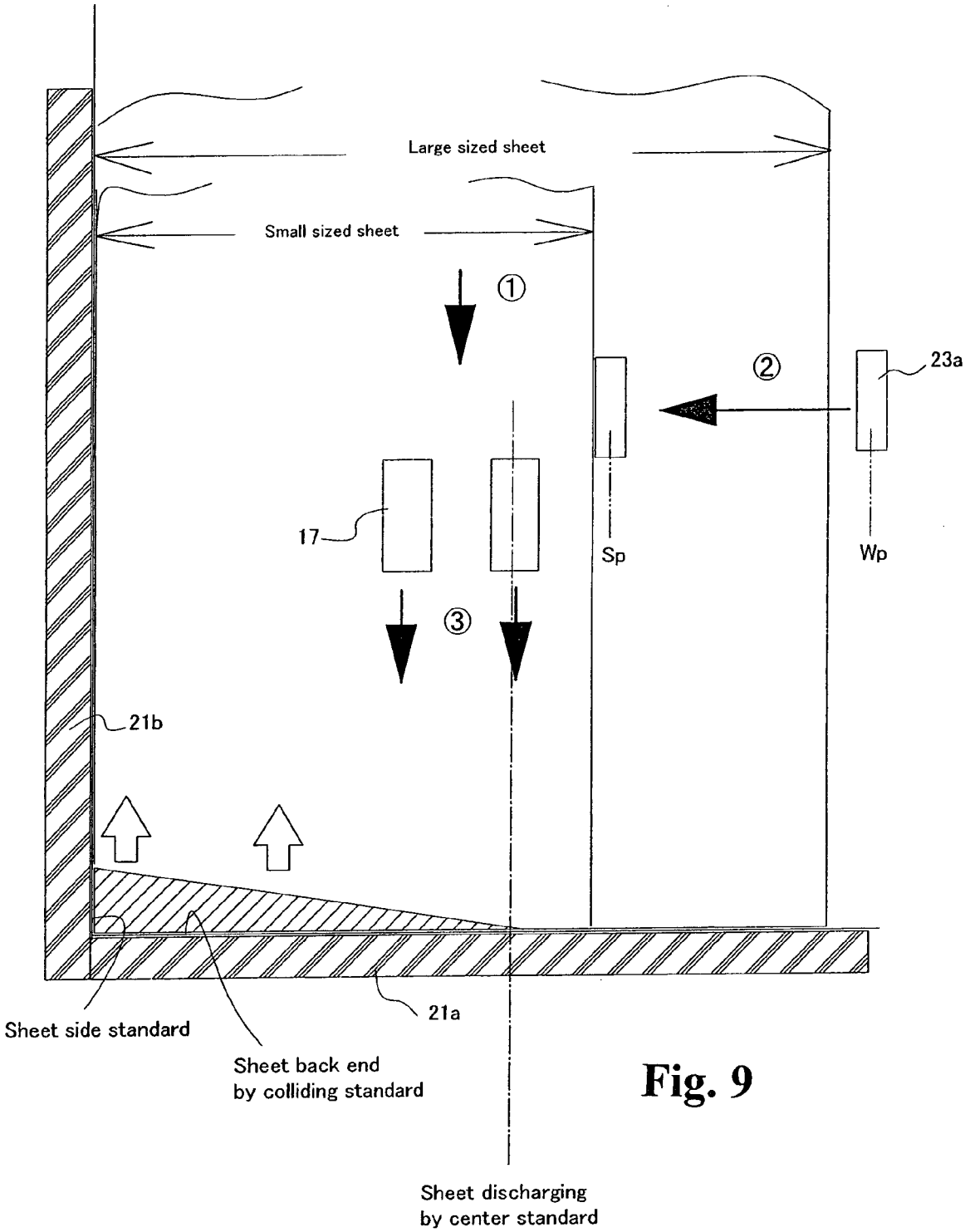
FIG. 9 is an explanatory view of the sheet aligning condition in the embodiment of FIG. 3.

The above mentioned sheet aligning condition will be explained in reference to FIG. 9. The sheets delivered on the process tray 20 at the center standard are (1) firstly delivered by the belt delivering means 17 to the position of colliding at the sheet back ends with the regulating stopper 21*a* (otherwise immediately before). (2) Next, the sheets are moved to the side standard 21*b* under the condition that the belt delivering means 17 retreats to the non-operating position. (3) The sheets are, then, delivered by the belt delivering means 17 having returned to the operating position. In the order of (1) delivering in the delivering direction, (2) delivering in the width direction and (3) delivering in the delivering direction, the sheets are delivered on the process tray 20, and therefore, damages caused when the sheets collide at the back ends with the regulating stopper 21*a* have substantially uniform force, so that the sheets are prevented from corner bending.

Next, explanation will be made, referring to FIG. 10, to an embodiment (called as "second embodiment" hereafter) different from the embodiment (called as "first embodiment" hereafter) based on FIGS. 3(*a*) and 3(*b*). The first embodiment shows the case that "when the aligning means 23 moves the sheets to regulate the sheets width ends, the belt delivering means 17 is retreated to the non-operating position" and the other case that "after completion of delivering the sheet width end, the belt delivering means 17 advances the sheets". The second embodiment of FIG. 10 shows a case that "when the sheets are delivered to regulate the sheets width ends, the belt delivering means 17 reduces pressing force (engaging force) to the sheets" and another case that "before completion of delivering the sheet width end, the belt delivering means 17 advances the sheets", and similar results to the above mentioned will be obtained. As to others, for example, the aligning means, the reciprocally rotating roller means, or the process tray are the same as those above mentioned, and explanations of them are omitted.

In the embodiment shown in FIGS. 10(*a*)-10(*c*), the stationary pulley 16*a* secures the belt delivering means 17 (the discharged sheet delivering means) to the apparatus frame similarly to the above mentioned, and the movable pulley 16*b* is supported by the rocking arm member 19 pivoted on the rotating shaft 16*c*, and the caterpillar belt 18 is bridged between both pulleys 16*a* and 16*b*. The drive motor M1 is connected to the rotating shaft 16*c*. The belt delivering means 17 similarly structured as mentioned above is furnished with a weight member 41 for adjusting strongly or weakly pressure to the sheets on the process tray 20. The weight member 41 is movably pivoted by a rotating shaft 16*c* under conditions of adding its weight to the rocking arm member 19 and adding no weight by separating therefrom. The weight member 41 is connected with a shift means 28 and is movable among the retreating position of separating the rocking arm member 19 from the sheets on the process tray of FIG. 10(*a*), the non-operating condition of contacting the sheets on the process tray 20 under no addition (own-weight of the belt delivering means 17) and the operating condition of contacting the sheets on the process tray 20 of FIG. 10(*c*) (under the condition of adding the weight of the weight member 41).

The weight member 41 is provided with a weight control groove 41*a* into which a control pin 19*a* disposed in the rocking arm member 19 is fitted. On the other hand, the weight member 41 is connected, via shaft, with a link member 28*b* composing the shift means 28, and the link member 28*b* is structured to perform crank movement around the rotating shaft 28*a*. The rotating shaft 28*a* is connected to a control motor M3 (not shown), and by rotating the control motor M3 in the clockwise direction, the link member 28*b* moves the weight member 41 to the conditions of FIG. 10(*a*), 10(*b*) and 10(*c*). By moving the attitudes of the weight member 41, the belt delivering means 17 is moved to the retreating position under the condition of FIG. 10(*a*), to the non-operating position under the condition of the same 10(*b*) of contacting the uppermost sheet on the process tray 20, and to the operating position under the condition of the same 10(*c*) of adding the weight of the weight member 41 to the rocking member 19 via the control pin 19*a* under the pressing condition.

Figure 8:
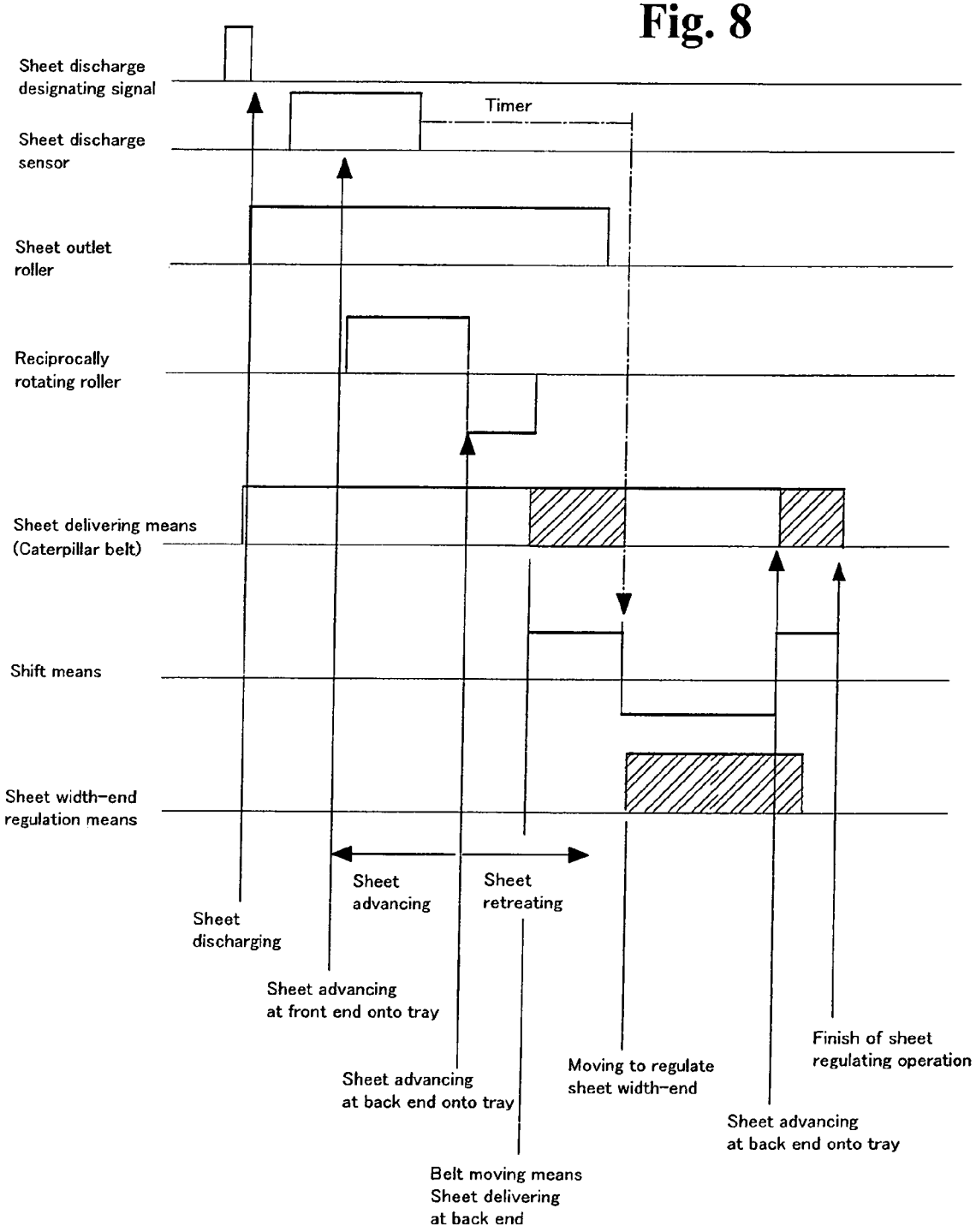
FIG. 8 is timing charts of the embodiment of FIG. 10.

The control means 50 composed of a control CPU (not shown) is based on the timing chart shown in FIG. 8, and controls the belt delivering means 17 and the aligning means 23. Omitting an explanation overlapping with the above mentioned, the sheets are delivered from the sheet outlet 13 onto the process tray under the condition of FIG. 10(*a*), and are reversely switched back by the reciprocally rotating roller means 26. At an operating stage when the sheet back ends advance under the belt delivering means 17, the reciprocally rotating roller means 26 is retreated, and at the same time, the control means 50 operates the control motor M3, so that the shift means 28 moves to the operating condition of FIG. 10(*c*). Then, the sheets collide with the regulating stopper 21*a* by the belt delivering means 17 or come near thereto. At this stage, the control means 50 reversely rotates the control motor M3 (in the counterclockwise direction), and moves the belt delivering means 17 to the non-operating condition of FIG. 10(*b*).

Subsequently, the control means 50 operates the drive motor M2 to move the aligning means 23 from the waiting position Wp toward the aligning position Sp. At this time, the sheets are given delivering force in the retreating direction, but the influence thereby is lightened. The sheets are moved in the direction crossing the delivering direction, comes near to the side regulating stopper 21*b*. Then, the control 50 rotates the control motor M3 in the clockwise direction to return the belt delivering means 17 to the operating position of FIG. 10(*c*) and moves the sheets in the delivering direction (in the retreating direction). The sheets complete, at this time, movement to regulate the sheet width ends by the aligning means 23, and the regulating plate 23*a* stops at this position (the position of the side regulating stopper 21*b*) and finishes movement to regulate the sheet width ends. After completing movement to regulate the sheet width ends, the control means 50 maintains the belt delivering means 17 for a predetermined time at the operating position in order to accurately collide the sheets with the regulating stopper 21*a* and align them. After finishing this operation, the control means 50 moves the belt delivering means 17 to the retreating position of FIG. 10(*a*), and prepares for a subsequent delivery of the sheets.

As mentioned above, the present invention (1) delivers the sheets by the belt delivering means 17 to the position (otherwise immediately before) colliding the sheet back ends with the regulating stopper 21*a*, (2) starts to move the sheets toward the sheet side regulating stopper 21*b* by means of the aligning means 23 under the condition of retreating the belt delivering means 17 to the non-operating position, (3) moves the sheets to the side of the regulating stopper 21*a* by the belt delivering means 17 returning to the operating position, and stops the belt delivering means 17 after the predetermined time of completing movement to regulate the sheet width ends. Also in this manner, the same aligned condition as mentioned above can be obtained.

The disclosure as disclosed in Japanese Patent Application No. 2006-239580 filed on Sep. 4, 2006 is incorporated herein.

While the invention has been explained with reference to the specific embodiments of the invention, the explanation is illustrative, and the invention is limited only by appended claims.

What is claimed is:

1. A sheet aligning apparatus, comprising:

a sheet outlet for discharging sheets, a tray device for piling and storing the sheets from the sheet outlet, a sheet discharging and delivering device arranged above the tray device for delivering a sheet from the sheet outlet to a sheet discharging direction and then delivering the sheet on the tray device, a reciprocally delivering roller situated near the sheet discharging and delivering device for receiving the sheet discharged in the sheet discharging direction from the sheet discharging and delivering device, and delivering the sheet toward the tray device, a shift device for moving the sheet discharging and delivering device between an operating position of pressing an uppermost sheet with a predetermined pressing force and a non-operating position of lightening or releasing the pressing force, a regulating stopper member for colliding the sheet sent by the sheet discharging and delivering device at a sheet front or back end therewith for regulating a sheet position, an aligning device for regulating the sheet on the tray device in a direction crossing the sheet discharging direction, a sheet pressing member swingably attached to the sheet discharging and delivering device to obliquely extend toward the stopper member, said sheet pressing member contacting the upmost sheet on the tray device to press the sheet thereon, and a control device for controlling the sheet discharging and delivering device, the reciprocally delivering roller, the shift device and the aligning device, wherein the control device:

(1) operates the sheet discharging and delivering device to send the sheet discharged from the sheet outlet onto the tray device toward the regulating stopper member, (2) controls the shift device for lightening or releasing a pressing force exerting on the uppermost sheet on the tray device by the sheet discharging and delivering device, (3) operates the aligning device, and moves the sheet on the tray device to regulate a sheet width in a direction crossing the sheet discharging direction, and (4) subsequently, stops the aligning device, and controls the sheet discharging and delivering device again to position and regulate the sheet with respect to the regulating stopper device.

2. A sheet aligning apparatus according to claim 1, wherein the sheet discharging and delivering device comprises a sheet feeding and rotating body including a belt or a roller, the aligning device comprises a regulating plate arranged to reciprocally move on the tray device and moves while pressing the uppermost sheet at its side end, and the shift device, is arranged to move the sheet feeding and rotating body to a retreating position retreating from the uppermost sheet on the tray device, an engaging position of contacting to the sheet, and the operating position pressing the uppermost sheet at the predetermined force.

3. A sheet aligning apparatus according to claim 1, wherein the aligning device includes a side regulating stopper colliding the sheet side end and crossing the regulating stopper member, and a stapler device for stapling sheet corners, said side regulating stopper and the stapler device being provided on the tray device.

4. A post processing apparatus, comprising:

the sheet aligning apparatus according to claim 1, a stapling device arranged on the process tray, and a sheet stack delivering device for delivering the stack of the sheets on the process tray to a storing stacker at a downstream side.

5. An image forming apparatus, comprising:

an image forming portion for forming images on sheets, and the post-processing apparatus for carrying out post processing according to claim 4.

* * * * *